United States Patent [19]

Klak

[11] Patent Number: 4,577,601

[45] Date of Patent: Mar. 25, 1986

[54] GLOW PLUG ARRANGEMENT

[75] Inventor: Roland Klak, Ost fildern, Fed. Rep. of Germany

[73] Assignee: Daimler-Benz Aktiengesellschaft, Fed. Rep. of Germany

[21] Appl. No.: 571,824

[22] Filed: Jan. 18, 1984

[30] Foreign Application Priority Data

Jan. 19, 1983 [DE] Fed. Rep. of Germany ..... 3301559

[51] Int. Cl.[4] ..... F02B 3/00

[52] U.S. Cl. ..... 123/298; 123/145 A; 219/270; 361/266; 431/262

[58] Field of Search ..... 123/143 R, 143 A, 280, 123/298, 557, 590; 219/267, 270; 361/266; 431/260, 261, 262

[56] References Cited

U.S. PATENT DOCUMENTS

| | | | |
|---|---|---|---|
| 1,341,478 | 5/1920 | Platt et al. | 123/298 |
| 1,421,594 | 7/1922 | Slettin | 123/280 |
| 2,762,348 | 9/1956 | Meurer | 123/280 X |
| 4,323,039 | 4/1982 | Tsugekawa et al. | 123/280 X |
| 4,345,555 | 8/1982 | Oshima et al. | 123/272 |
| 4,389,986 | 6/1983 | Tamasawa | 123/298 |

FOREIGN PATENT DOCUMENTS

| | | | |
|---|---|---|---|
| 395862 | 5/1924 | Fed. Rep. of Germany . | |
| 2734662 | 5/1978 | Fed. Rep. of Germany | 219/270 |
| 1116854 | 11/1961 | Fed. Rep. of Germany | 431/260 |
| 7139817 | 10/1971 | Fed. Rep. of Germany . | |
| 1526773 | 7/1972 | Fed. Rep. of Germany . | |
| 2042236 | 3/1978 | Fed. Rep. of Germany | 123/298 |
| 2640314 | 3/1978 | Fed. Rep. of Germany . | |
| 2802625 | 7/1979 | Fed. Rep. of Germany . | |
| 2368196 | 5/1978 | France . | |
| 628281 | 8/1949 | United Kingdom | 431/261 |
| 1354588 | 5/1974 | United Kingdom . | |
| 2041445 | 9/1980 | United Kingdom . | |

*Primary Examiner*—Volodymyr Y. Mayewsky
*Attorney, Agent, or Firm*—Barnes & Thornburg

[57] ABSTRACT

In a compressed air charged combustion engine, in order to improve the atomization and ignition of the injected fuel from an injection nozzle, a glow plug which extends out of its glow plug housing with a cylindrically formed heating rod is provided with an irregular outer surface in the region which is impinged by the stream of fuel. The heating rod exhibits a cylindrical form and is provided with ring grooves to form the irregular surface area. Moreover the fuel stream meets at a sharp angle onto the heating rod.

5 Claims, 1 Drawing Figure

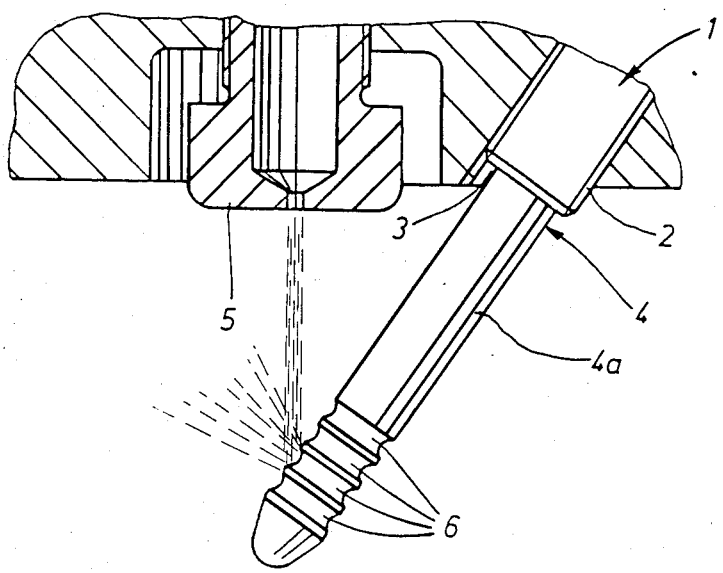
1
2
3
4
4a
5
6

GLOW PLUG ARRANGEMENT

BACKGROUND AND SUMMARY OF THE INVENTION

The invention relates to a glow plug arrangement for an air charged injection combustion engine.

French Patent (FR-PS) No. 76 30 914 discloses a glow plug for the vaporization and ignition of fluid fuel. The glow plug is provided with a cylindrical, smooth heating rod part which is disposed in the injection region of two fuel streams of an injection nozzle arranged at right angles to the heating rod. Glow plugs of this kind are not suitable to fulfill the efficient intensive atomization and disturbance free ignition of the fuel.

The invention is based upon the problem to achieve improved fuel conditioning and ignition by providing a glow plug arrangement requiring a small construction space and of simplified construction.

The solution of this problem is inventably obtained by providing that the heating rod is disposed at a sharp angle to the injected fuel stream and is provided in the region impinged on by the fuel stream with an irregular surface to improve the atomization and ignition of the fuel, said irregular surface being formed as a plurality of ring grooves around the circumference of the heating rod.

In German published application (DE OS) No. 26 40 314 a glow plug is disclosed with an uneven surface at the free end of the heating rod part. However, in this arrangement the thread formed indentations at the rod part serve as a guide for a resistance heater wire. Because of the rounded outer surface of the heating rod in this arrangement, no splitting up of the fuel into the smallest drops is achieved.

Through the inventive measures, namely to provide the heating rod of the glow plug with sharp edged outer surface parts in the region of the compact impinging fuel stream, the injected fuel from the injection nozzle is so split up that the fuel is divided into many small droplets. Therewith a large fuel outer surface area results which is associated with a good gas mixture with the air to form a readily combustible gas mixture.

Further objects, features, and advantages of the present invention will become more apparent from the following description when taken with the accompanying drawing which shows, for purposes of illustration only, an embodiment in accordance with the present invention.

BRIEF DESCRIPTION OF THE DRAWINGS

The single drawing FIGURE is a part sectional schematic view depicting the injection nozzle and glow plug arrangement for a single combustion engine combustion space constructed in accordance with a preferred embodiment of the invention.

DETAILED DESCRIPTION OF THE DRAWINGS

In the single drawing FIGURE there is shown a glow plug 1 arranged for the vaporization and ignition of fluid fuel in a combustion space of a vehicle engine or the like. Glow plug 1 includes a glow plug housing 2 and a heating rod 4 inserted in a longitudinally extending bore 3 of the housing 2, which heating rod protrudes out of the housing 2 with its free rod part 4*a* disposed at a sharp angle to the fuel injection nozzle 5.

The free rod part 4*a* is configured with a smooth cylindrical surface over most of its length. However in a region which is impinged by a massive fuel stream from the injection nozzle 5, rod part 4*a* is provided with special necked rings. In the illustrated embodiment, this region of rod part 4*a* is provided with four adjacent ring grooves 6 which flay the impinging fuel stream. The ring grooves 6 are so arranged in depth, distance, and shape that an excellent wall strength for maintaining the rigidity of the rod part 4*a* is assured.

Practical embodiments of the invention include the following dimensions:

radius of ring grooves 6 of 0.20 mm to 0.30 mm, with 0.25 mm being especially preferred;

depth of ring grooves 6 of 0.20 mm to 0.30 mm, with 0.25 mm being especially preferred;

distance between the middle of adjacent ring grooves 6 of 0.60 mm to 0.90 mm, with 0.75 mm being especially preferred; and number of ring grooves 6 between 10 and 20 with 14 grooves 6 being especially preferred The ring grooves 6 are preferably manufactured either by cutting or through mechanical deformation of the material forming rod part 4*a*.

According to especially preferred embodiments of the invention, the insertion of the glow plug 1 with the enlarged surface area rod part 4*a* is primarily provided for so-called flame start devices, in order at low temperatures to have good starting characteristics as well as a disturbance free warm-up phase of the combustion engine as a result of the pre-warmed combustion air.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Glow plug arrangement for a compressed air charged combustion engine for motor vehicles and the like, comprising:

a glow plug housing; and a heating rod extending outwardly of the housing into an engine combustion space in a region intersecting with a fuel stream supplied from an injection nozzle;

wherein the heating rod is disposed at a sharp angle to the injected fuel stream and is provided in the region impinged on by the fuel stream with an irregular surface to improve the atomization and ignition of the fuel, said irregular surface being formed as a plurality of ring grooves around the circumference of the heating rod, and wherein said ring grooves include sharp edged outer surface portions.

2. An arrangement according to claim 1, wherein the heating rod is cylindrical in shape and wherein the ring grooves are formed adjacent the free end of the heating rod opposite the glow plug housing.

3. An arrangement according to claim 2, wherein at least four of said ring grooves are provided.

4. Glow plug arrangement for a compressed air charged combustion engine for motor vehicles and the like, comprising:

a glow plug housing; and a heating rod extending outwardly of the housing into an engine combustion space in a region intersecting with a fuel stream supplied from an injection nozzle;

wherein the heating rod is disposed at a sharp angle to the injected fuel stream and is provided in the region impinged on by the fuel stream with an irregular surface to improve the atomization and ignition of the fuel, said irregular surface being formed as a plurality of ring grooves around the circumference of the heating rod, wherein the heating rod is cylindrical in shape and wherein the ring grooves are formed adjacent the free end of the heating rod opposite the glow plug housing; and wherein the radius of each ring groove is between 0.20 mm and 0.30 mm, wherein the depth of each ring groove is between 0.20 mm and 0.30 mm, wherein the distance between the middle of adjacent ring grooves is between 0.60 mm and 0.90 mm, and wherein between 10 and 20 of said ring grooves are provided.

5. An arrangement according to claim 4, wherein said ring grooves include sharp edged outer surface portions.

* * * * *